US010199181B2

(12) United States Patent
Lehmann

(10) Patent No.: US 10,199,181 B2
(45) Date of Patent: Feb. 5, 2019

(54) HOLDING DEVICE FOR RECEIVING SWITCHING ELEMENTS FOR A COMMAND AND ALERT DEVICE

(71) Applicant: Siemens Aktiengesellschaft, Munich (DE)

(72) Inventor: Hanna Lehmann, Hellikon (CH)

(73) Assignee: Siemens Aktiengesellschaft, Munich (DE)

( * ) Notice: Subject to any disclaimer, the term of this patent is extended or adjusted under 35 U.S.C. 154(b) by 5 days.

(21) Appl. No.: 15/356,239

(22) Filed: Nov. 18, 2016

(65) Prior Publication Data

US 2017/0140882 A1 May 18, 2017

(30) Foreign Application Priority Data

Nov. 18, 2015 (EP) ..... 15195116

(51) Int. Cl.

| | |
|---|---|
| ***H01H 3/32*** | (2006.01) |
| ***H01H 3/02*** | (2006.01) |
| ***H01H 19/14*** | (2006.01) |
| ***H01H 25/04*** | (2006.01) |
| *H01H 13/04* | (2006.01) |
| *H01H 13/50* | (2006.01) |
| *H01H 19/04* | (2006.01) |

(52) U.S. Cl.

CPC ..... *H01H 3/022* (2013.01); *H01H 3/32* (2013.01); *H01H 19/14* (2013.01); *H01H 25/04* (2013.01); *H01H 13/04* (2013.01); *H01H 13/503* (2013.01); *H01H 19/04* (2013.01); *H01H 2003/0233* (2013.01); *H01H 2231/016* (2013.01)

(58) Field of Classification Search

CPC .... H01H 19/14; H01H 2221/01; H01H 25/06; H01H 25/008; H01H 25/065; H01H 3/022; H01H 25/04; H01H 2003/0233; H01H 3/32; H01H 13/503; H01H 19/04

USPC ..... 200/4, 336, 316, 329, 11 R, 564, 200/293–297, 281

See application file for complete search history.

(56) References Cited

U.S. PATENT DOCUMENTS

| | | | | |
|---|---|---|---|---|
| 4,282,414 | A | 8/1981 | Johnston et al. | |
| 2013/0248340 | A1* | 9/2013 | Lehmann ..... | H01H 13/81 200/530 |

FOREIGN PATENT DOCUMENTS

| | | | |
|---|---|---|---|
| DE | 83 03 882 | U1 | 6/1983 |
| DE | 103 10 494 | A1 | 9/2004 |
| DE | 10 2010 041 041 | A1 | 3/2012 |
| WO | WO 2012/072809 | A1 | 6/2012 |

* cited by examiner

*Primary Examiner* — Ahmed Saeed
(74) *Attorney, Agent, or Firm* — Cozen O'Connor

(57) ABSTRACT

A holding device for receiving switching elements for a command and alert device, with a first housing portion in which a recess for receiving an actuator of a command and alert device is arranged, and with a second housing portion arranged on the first housing portion and which continues the recess of the first housing portion, where guide rails for guiding transmission elements are formed in the housing portions, and where the transmission elements transmit an actuation of the actuator to a switching element.

22 Claims, 4 Drawing Sheets

HOLDING DEVICE FOR RECEIVING SWITCHING ELEMENTS FOR A COMMAND AND ALERT DEVICE

BACKGROUND OF THE INVENTION

1. Field of the Invention

The invention relates to a holding device for receiving switching elements for a command and alert device, with a first housing portion in which a recess for receiving an actuator of a command and alert device is arranged, and with a second housing portion which is arranged on the first housing portion and which continues the recess of the first housing portion.

2. Description of the Related Art

Command and alert devices with holding devices are used in machines or electrical installations that are operated via command devices, such as pushbuttons or selector switches, which act on the control. These command devices are mounted in control panels, operator panels, switching cabinet doors or housing covers. Command devices are generally of modular construction. This means that they consist of an actuator, a holding device, such as an annular nut, or a special mounting holder, and one or more switching elements, which are formed as switching elements of break contacts or make contacts. For mounting, the actuator is generally guided through an opening in the control panel from the front and is mounted from the rear via a fastening part. Switching elements are mechanically secured to the actuator or to the holding device by screws, snap hooks or catches. The electrical connection of the switching elements to the control occurs via connection terminals.

In safety applications, such as an emergency-off command device, it is stipulated that the signal is generated by the opening of positive-opening contacts. This means that, in an unactuated emergency-off command device, the contacts are closed and consequently so is the associated circuit. In the event of a fault or emergency, the break contact is interrupted by striking the emergency-off actuator, which is located in front of the control panel, and this puts the installation or machine in a safe state. However, this only works if the spatial assignment between the actuator and the switching element is ensured. Defective mounting or violent action may have the effect that the switching elements are mechanically separated from the actuator. In this case, the emergency-off command device is no longer operational. That is, if actuated in the event of an emergency, then the contacts are not opened, and consequently the dangerous state is also not rectified. This may lead to fatal harm. Therefore, the secure connection between the actuator and the switching element is of paramount importance.

In addition to the handling, the optics, the fixed seat, the reliability and the quality, a further decisive product feature for a command and alert device is also the reliable connection of a plurality of switching elements to an actuator designed as a crossbar switch or as a selector switch, or to a holding device.

SUMMARY OF THE INVENTION

Accordingly, it is the object of the present invention to provide a holding device for switching elements of a command and alert device and also a command and alert device with such a holding device that permit the connection of a plurality of switching elements.

This and other objects and advantages are achieved in accordance with the invention by a holding device for receiving switching elements for a command and alert device, with a first housing portion in which a recess for receiving an actuator of a command and alert device is arranged, and with a second housing portion that is arranged on the first housing portion and which continues the recess of the first housing portion. The invention is distinguished in that guide rails for guiding transmission elements are formed in the housing portions, where the transmission elements transmit an actuation of the actuator to a switching element.

A plurality of switching elements, preferably at least four, are activated via the actuator. For this purpose, a reliable triggering mechanism is required that transmits the change in switching position from the actuator to the activated switching element. The preferably cylindrically designed basic body of the actuator has only a certain construction space. As a result, the rams in the actuator are configured such that one part of the rams grips directly on a part of the switching elements, while the other part of the rams grips on the corresponding switching elements via the transmission elements in the holding device. The rams in the actuator preferably differ in configuration here, i.e., for example, the space-requiring rams directly activate the respective switching elements, while the rams with a smaller construction volume initially grip on the transmission elements before the corresponding switching element is then activated via the latter.

In a special embodiment in accordance with the invention, each transmission element is acted upon by a spring element. The spring element is preferably configured as a compression spring and serves for resetting the transmission element. The resetting of the transmission element is essential in order, after activation of a first switching element, to be able to activate a second switching element.

In a special embodiment of the invention, the transmission elements are L-shaped with two limbs. This configuration of the transmission element makes it possible firstly to fixedly secure the transmission element in the holding device and secondly to provide the ram of the actuator with a sufficient contact surface in order to achieve a safe change in switching position.

In a further embodiment in accordance with the invention, one limb of the transmission element is guided in the guide rail of the first and second housing portion. The transmission element is thereby fixedly secured in the holding device.

In a particularly advantageous embodiment of the invention, the second limb has a portion that is U-shaped and merges via a connecting web into the first limb. The U-shaped portion forms the contact surface with the ram of the actuator.

In a special embodiment of the invention, the second limb is formed such that it projects into the recess. This positioning of the second limb permits direct access of the ram of the actuator to this part of the transmission element.

In a further embodiment of the invention, a receptacle for the spring element is arranged in the form of a housing contour on the transmission element. The housing contour makes it possible to secure the spring element in a stable position, and therefore the resetting of the transmission element, and therefore the resetting of the switching element, can be permanently ensured.

In a further embodiment the invention, a clamping ring that is operable via a lever and that secures the actuator in the recess is arranged in the housing portions of the holding device. The clamping ring firstly permits the fixed positioning of the actuator in the holding device and secondly permits simple exchange of the actuator by the lever.

In a special embodiment of the invention, the holding device is configured to receive at least four switching elements. Four switching elements are required for special applications, such for the connection of a crossbar switch.

In a further embodiment in accordance with the invention, the switching elements are structurally identical standard switching elements. Associated with the use of structurally identical switching elements that are interchangeable among one another and do not have to adopt special positions on the holding device is the advantage that only one set of switching elements has to be manufactured for the holding device in accordance with the invention.

In a particular embodiment of the invention, the actuator with respect to its geometry has a basic body that is adapted to the recess of the holding device and which has guide pockets that guide rams mounted therein. The rams in the actuator also have to be secured in a stable position to ensure that the triggering mechanism consisting of actuator, holding device and switching element reliably interlocks.

In a particularly advantageous embodiment of the invention, the rams in the actuator can be actuated individually via the actuator. Via the rams to be activated individually, the switching elements positioned on the holding device are likewise activated individually.

In a particular embodiment of the invention, the rams are U-shaped with two limbs and a transition region, where the limbs of the ram, when actuated, strike against the limbs of the transmission element of the holding device. The rams that are U-shaped are the rams that require less construction space. These rams activate the switching elements indirectly via the transmission elements in the holding device.

In a particular embodiment in accordance with the invention, the rams in the actuator are L-shaped with two limbs, where one limb of the ram is guided in the basic body of the actuator and the other limb is oriented in the direction of the center point of the basic body. The L-shaped rams require more construction space in the interior of the cylindrical basic body of the actuator. The rams directly activate the corresponding switching elements.

In a particularly advantageous embodiment of the invention, four switching elements can be actuated by the actuator via the holding device. Four switching elements are required for special applications, such as for the connection of a crossbar switch.

In a special embodiment of the invention, the actuator is a crossbar switch. Four switching elements can be used for the connection of a crossbar switch because the crossbar switch can assume four defined switching positions.

In a further embodiment in accordance with the invention, the actuator is a selector switch. Four switching elements can also be used for the connection of a selector switch because the selector switch can assume four defined switching positions.

The objects upon which the disclosed embodiments of the invention are based is also achieved by a command and alert device with a holding device in accordance with the invention.

The holding device in accordance with the invention substantially has a cuboidal basic body with a first housing portion that has a preferably concentric recess for receiving an actuator of a command and alert device, and with a second housing portion which is preferably arranged lying against the first housing portion and which continues the recess of the first housing portion and which has guide rails for guiding transmission elements, where the transmission elements serve to transmit an actuation of an actuator to a switching element. The first and second housing portions may be formed in one part. However, they may also be formed in two parts, and therefore the second housing portion is fastened to the first housing portion, for example, via a detent or a screw connection or a clamping connection. A clamping ring is preferably arranged between the two housing portions, where the clamping ring is operable via a lever that fixedly secures the actuator in the recess of the holding device. The actuator can also be released again via the lever in order, for example, for the actuator to be exchanged. Housing contours in the form of projections that predetermine the correct position of the actuator upon insertion into the recess are arranged in the recess of the holding device.

At least four switching elements can be fastened to the holding device in accordance with the invention. Here, the switching elements can be of structurally identical design, i.e., standard switching elements can be used. No special switching elements have to be manufactured. Two of the switching elements can be activated via the preferably two transmission elements arranged in the holding device. The other switching elements are activated directly via the actuator.

The transmission elements are preferably L-shaped with two limbs that are preferably at an angle of 90° to each other. Here, one limb of the transmission element is arranged in a guide rail of the second housing portion. The second limb of the transmission element has a preferably U-shaped portion with two limbs and a transition region that is connected to the first limb of the transmission element via a connecting web. The transmission element has a receptacle on the first limb for a spring element or a compression spring. The receptacle is preferably formed as a housing contour in the manner of a blind hole, with a centrally arranged guide dome. The spring element can be introduced into the blind-hole-like housing contour via the guide dome. The spring element serves for resetting the actuator.

The actuator is preferably configured as a crossbar switch or selector switch. The actuator preferably has a cylindrical basic body. Housing contours in the form of projections and recesses, which are configured to fit precisely with the housing contours in the recess of the holding device, are arranged on the outer side of the cylindrical basic body. At least four rams via which the switching elements on the holding device can be activated either directly or indirectly are preferably arranged in the cylindrical basic body. The actuator has an activation mechanism that individually activates the rams. The rams in the actuator are either preferably U-shaped or L-shaped. The U-shaped rams and the L-shaped rams are arranged opposite and parallel to one another. When the U-shaped rams are actuated, two limbs protrude out of the cylindrical basic body of the actuator. The limbs of the ram of the actuator, when actuated, strike against the U-shaped limbs of the transmission element of the holding device. The limbs, which are of L-shaped with respect to one another, of the ram of the actuator strike directly against the switching elements with the surface of the limb that is oriented into the interior of the cylindrical basic body of the actuator, where the limbs are at an angle of approx. 90° to one another. The other limb of the L-shaped ram of the actuator is positioned in guide pockets on the housing edge of the cylindrical basic body of the actuator.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

Further embodiments and advantages of the invention are explained below with reference to exemplary embodiments and with reference to the drawing, in which, schematically.

DETAILED DESCRIPTION OF THE EXEMPLARY EMBODIMENTS

Figure 1:
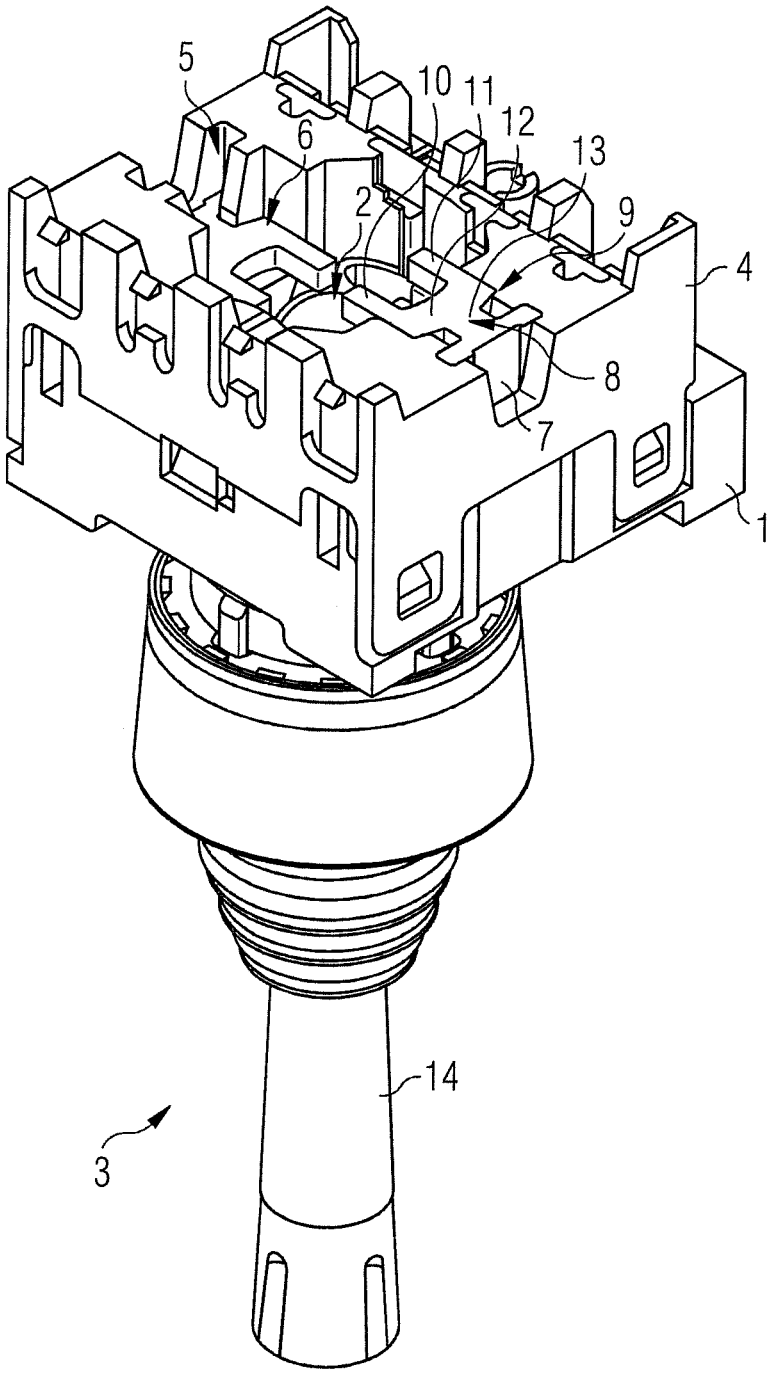
FIG. 1 shows, in a perspective illustration, an exemplary embodiment of a crossbar switch with a holding device in accordance with the invention.

FIG. 1 shows a holding device in accordance with the invention in combination with a crossbar switch as actuator. The holding device in accordance with the invention substantially has a cuboidal basic body with a first housing portion 1 that has a preferably concentric recess 2 for receiving an actuator 3 of a command and alert device, and with a second housing portion 4 that is arranged on the first housing portion 1, preferably in a manner lying there against, and which continues the recess 2 of the first housing portion 1 and which has guide rails 5 for guiding transmission elements 6, where the transmission elements 6 serve to transmit an actuation of an actuator 3 to a switching element. The first and second housing portions 1, 4 may be formed in one part. However, they may also be formed in two parts, and therefore the second housing portion 4 is fastened to the first housing portion 1, for example, via a detent or a screw connection or a clamping connection. A clamping ring is preferably arranged between the two housing portions 1, 4, where the clamping ring is operable via a lever that fixedly secures the actuator 3 in the recess 2 of the holding device. The actuator 3 can also be released again via the lever in order, for example, to exchange the actuator. Housing contours formed as projections or recesses that predetermine the correct position of the actuator 3 upon insertion into the recess 2 are arranged in the recess 2 of the holding device.

At least four switching elements can be fastened to the holding device in accordance with the invention. Here, the switching elements can be of structurally identical configuration, i.e., standard switching elements can be used. No special switching elements have to be manufactured. Two of the switching elements can be activated via the transmission elements 6 arranged in the holding device. The other switching elements are activated directly via the actuator 3.

The transmission elements 6 are preferably L-shaped with two limbs 7, 8 that are preferably at an angle of 90° to each other. Here, one limb 7 of the transmission element 6 is arranged in a guide rail 5 of the second housing portion 4. The other limb 8 of the transmission element 6 has a preferably U-shaped portion 9 with two limbs 10, 11 and a transition region 12 that is connected to the first limb 7 of the transmission element 6 via a connecting web 13.

The actuator 3 in FIG. 1 is a crossbar switch. The actuator 3 preferably has a cylindrical basic body that is inserted into the recess 2 of the holding device. At least four rams are preferably arranged in the cylindrical body, via which rams the switching elements on the holding device can be activated directly or indirectly via the transmission elements 6 of the holding device. The actuator 3 has an activation mechanism which is realized via the joystick 14 and which individually activates the rams.

Figure 2:
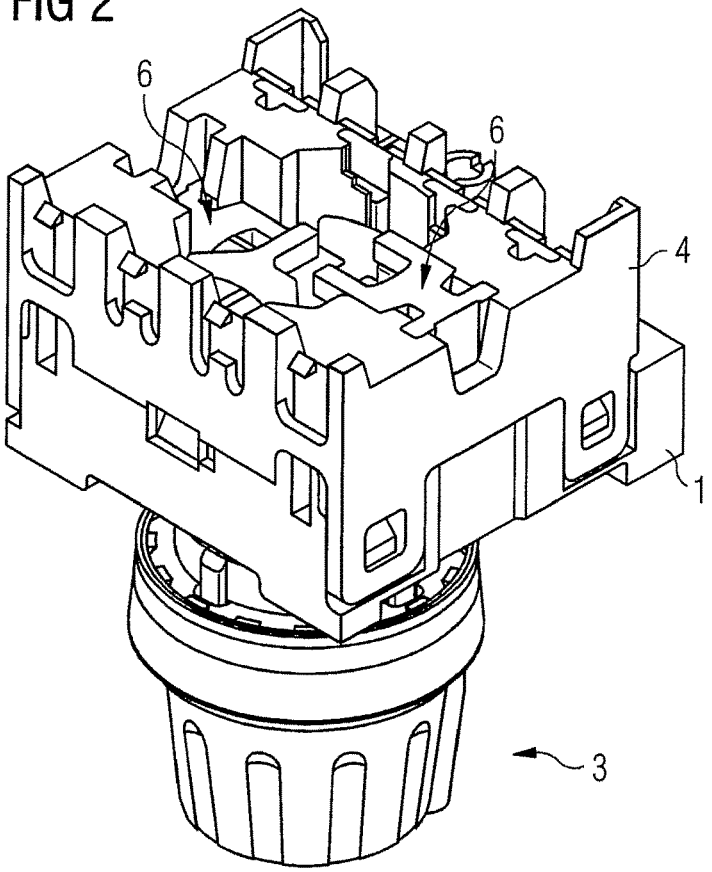
FIG. 2 shows, in a perspective illustration, a selector switch with a holding device in accordance with the invention.

FIG. 2 illustrates a further exemplary embodiment of the combination of actuator 3 and holding device in accordance with the invention for the switching elements. In this exemplary embodiment, the actuator 3 is a selector switch that is operated by rotation. The transmission elements 6 in the holding device in accordance with the invention are arranged in parallel and lying opposite one another. The outer switching elements, which are each located on the edge of the housing outer sides of the holding device, are activated via the transmission elements 6.

Figure 3:
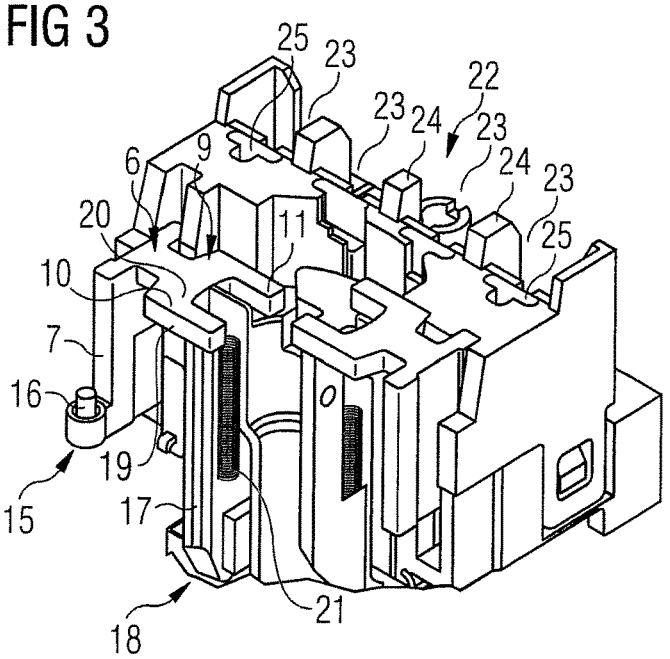
FIG. 3 shows, in a perspective illustration, a detail of the holding device in accordance with the invention with transmission elements.

FIG. 3 shows a detail of the holding device in accordance with the invention with transmission elements 6. The transmission element 6 has a receptacle 15 on the first limb 7 for a spring element, preferably a compression spring. The receptacle 15 is preferably formed as a blind-hole-like housing contour with a centrally arranged guide dome 16. The mechanism of the holding device in accordance with the invention makes provision for the limbs 10, 11 of the U-shaped portion 9 to be acted upon, in the event of actuation, by the limbs 17 of the ram 18 of the actuator 3. A contact point 19 therefore arises between the transmission element 6 of the holding device and the ram 18 of the actuator 3. That surface of the U-shaped portion 9 of the transmission element 6 that lies opposite the contact point 19 serves as a contact surface 20 with respect to the switching element. A spring element 21, via which the ram 18 is reset, is arranged between the limbs 17 of the ram 18 of the actuator. In addition, four slots 23 for switching elements are preferably arranged on a longitudinal side 22 of the second housing portion 4, where the slots are characterized by positioning aids 24 in the form of housing projections and by recesses 25 in the longitudinal side 22 of the second housing portion 4.

Figure 4:
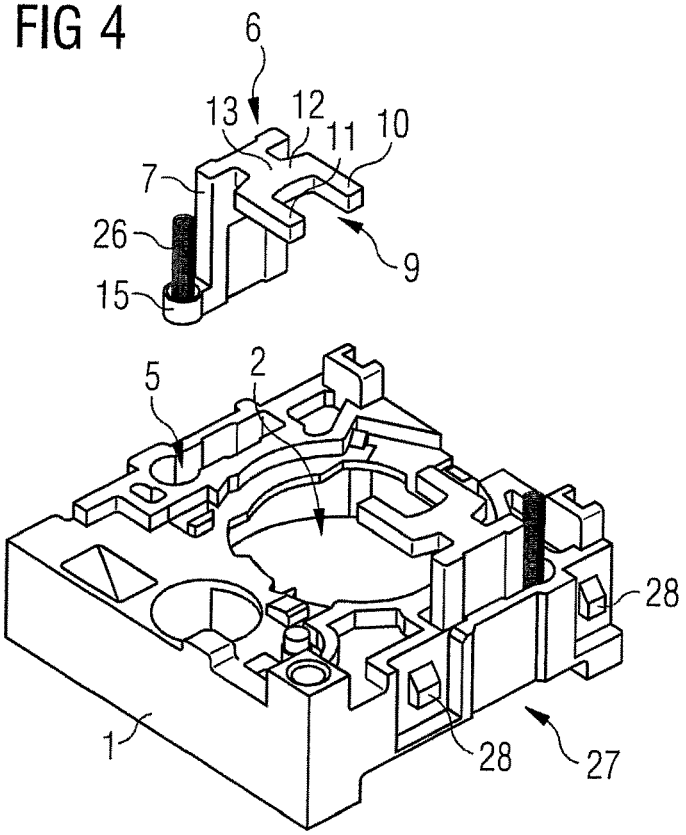
FIG. 4 shows, in a perspective illustration, the first housing portion of the holding device in accordance with the invention with a separate and inserted transmission element.

FIG. 4 shows the first housing portion 1 of the holding device in accordance with the invention with a transmission element 6 that is separate and is inserted. The transmission element 6 has the receptacle 15 on the first limb 7 for a spring element 26, preferably a compression spring. The receptacle 15 is preferably formed as a blind-hole-like housing contour with a centrally arranged guide dome 16. The spring element 26 can be inserted into the blind-hole-like housing contour via the guide dome 16. The spring element 26, serves for resetting the actuator 3. The transmission element 6 is inserted, together with the spring element 26, into the guide rail 5 of the first housing portion 1. Latching lugs 28, via which the second housing portion 4 can be secured on the first housing portion 1, are arranged on a side wall 27 of the first housing portion 1.

Figure 5:
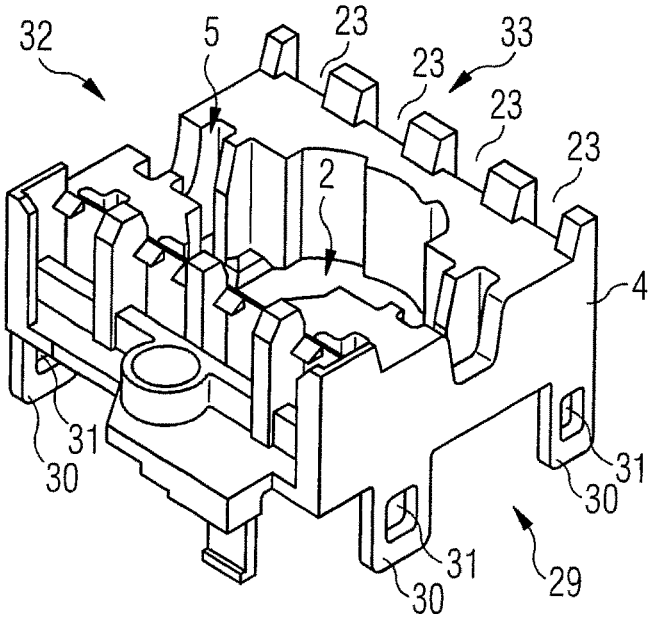
FIG. 5 shows, in a perspective illustration, the second housing portion of the holding device in accordance with the invention.

FIG. 5 illustrates the second housing portion 4 of the holding device in accordance with the invention. Housing projections 30 with recesses 31, which are configured to receive the latching lugs 28, are arranged on a side wall 29 of the second housing portion 4. This construction of housing projection 30 and recess 31 is also situated on the side wall 32 running parallel to the side wall 29. FIG. 5 shows the continuation of the recess 2 in the second housing portion 4. The slots 23 for the switching elements are arranged on the side wall 33 connecting the side walls 29 and 32. The guide rail 5 of the first housing portion 1 is continued in the second housing portion 4, where the first housing portion 1 forms the end stop for the transmission element 6 in the unactuated state.

Figure 6:
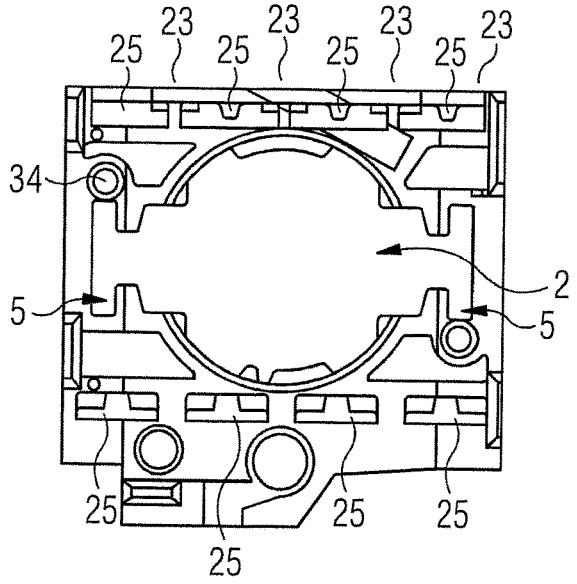
FIG. 6 shows, in a top view, the lower side of the second housing portion of the holding device.

FIG. 6 shows the lower side of the second housing portion 4 of the holding device in accordance with the invention with the four slots 23 for the switching elements, and with a receiving bore 34 for the spring element 26.

Figure 7:
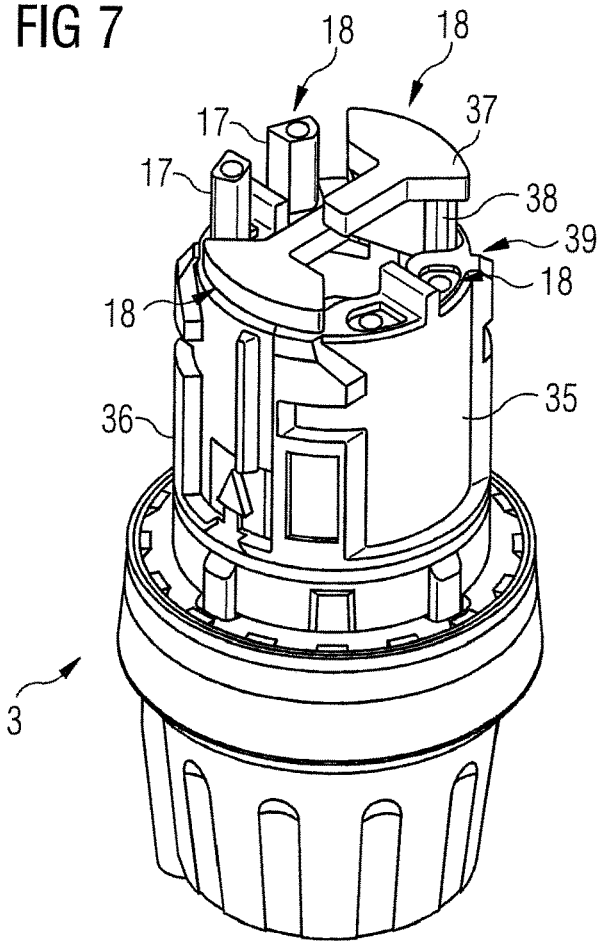
FIG. 7 shows, in a perspective illustration, an exemplary embodiment of an actuator.

FIG. 7 illustrates an exemplary embodiment of an actuator 3, preferably a selector switch. The actuator 3 preferably has a cylindrical basic body 35. Housing contours 36 in the form of projections and recesses, which are configured to precisely fit the housing contours in the recess 2 of the holding device, are arranged on the outer side of the cylindrical basic body 35. Preferably at least four rams 18 are arranged in the cylindrical basic body 35, via which rams the switching elements on the holding device can be activated. The actuator 3 has an activation mechanism that individually activates the rams 18. The rams 18 in the actuator 3 are either preferably U-shaped or L-shaped. The rams 18 that are U-shaped and the rams 18 that are L-shaped are arranged lying opposite each other in parallel in the cylindrical recess of the basic body of the actuator 3. When the U-shaped rams are actuated, two limbs 17 protrude out of the cylindrical basic body of the actuator 3. In the event of actuation, where the U-shaped limbs 17 of the ram 18 of the actuator 3 strike against the limbs 10, 11, which are U-shaped, of the transmission element 6 of the holding device. The rams 18 of the actuator 3, which are L-shaped, strike directly against the switching elements with the surface or with the limb 37 that is oriented into the interior of the cylindrical basic body of the actuator 3, where the limbs 37, 38 are at an angle of approx. 90° to each other. The other limb 38 of the L-shaped ram 18 of the actuator 3 is positioned in guide pockets 39 on the housing edge of the cylindrical basic body of the actuator 3.

The holding device in accordance with the invention is distinguished by transmission elements in the holding device, where the transmission elements transmit the ram movements of the actuator to the outer switching elements. In addition, the holding device is formed with at least four direct receptacles for switching elements. The holding device in accordance with the invention permits the use of structurally identical standard switching elements.

Thus, while there have shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A holding device for receiving switching elements for a command and alert device, comprising:

a first housing portion in which a recess for receiving an actuator of a command and alert device is arranged;

a second housing portion arranged on the first housing portion and which continues the recess of the first housing portion; and a plurality of L-shaped transmission elements, each of the transmission elements having two limbs and being arranged latitudinally opposite to each other;

wherein guide rails for guiding the L-shaped transmission elements are formed in the first and second housing portions; and wherein the L-shaped transmission elements transmit an actuation of the actuator to a switching element.

2. The holding device as claimed in claim 1, wherein each L-shaped transmission element of the plurality of L-shaped transmission elements is acted upon by a spring element.

3. The holding device as claimed in claim 1, wherein one limb of an L-shaped transmission element of the plurality of L-shaped transmission elements is guided in the guide rail of the second housing portion.

4. The holding device as claimed in claim 1, wherein the second limb has a U-shaped portion which merges via a connecting web into a first limb of the two limbs.

5. The holding device as claimed in claim 3, wherein the second limb has a U-shaped portion which merges via a connecting web into a first limb of the two limbs.

6. The holding device as claimed in claim 1, wherein the second limb of the two limbs is formed so as to project into the recess.

7. The holding device as claimed in claim 3, wherein the second limb of the two limbs is formed so as to project into the recess.

8. The holding device as claimed in claim 4, wherein the second limb of the two limbs is formed so as to project into the recess.

9. The holding device as claimed in claim 2, wherein a receptacle for the spring element comprising a housing contour and arranged on the L-shaped transmission element.

10. The holding device as claimed in claim 1, wherein a clamping ring which is operable via a lever and which secures the actuator in the recess is arranged in the first and second housing portions of the holding device.

11. The holding device as claimed in claim 1, wherein the holding device is configured to receive at least four switching elements.

12. The holding device as claimed in claim 11 wherein the at least four switching elements are structurally identical standard switching elements.

13. The holding device as claimed in claim 1, wherein the actuator has a geometry formed as a basic body which is adapted to the recess of the holding device and which has guide pockets which guide rams mounted therein.

14. The holding device as claimed in claim 13, wherein the rams in the actuator are actuateable individually via the actuator.

15. The holding device as claimed in claim 13, wherein the rams are U-shaped with two limbs and a transition region; the two limbs of the ram, when actuated, striking against two limbs of the L-shaped transmission element of the holding device.

16. The holding device as claimed in claim 13, wherein the rams in the actuator are L-shaped with two limbs; wherein one limb of the ram is guided in guide pockets of the actuator and another limb of the ram is oriented in a direction of a center point of a basic body of the actuator.

17. The holding device as claimed in claim 11, wherein the at least four switching elements are actuateable by the actuator via the holding device.

18. The holding device as claimed in claim 1, wherein the actuator is a crossbar switch.

19. The holding device as claimed in claim 1, wherein the actuator is a selector switch.

20. A command and alert device having the holding device as claimed in claim 1.

21. A holding device for receiving switching elements for a command and alert device, comprising:

a first housing portion in which a recess for receiving an actuator of a command and alert device is arranged; and a second housing portion arranged on the first housing portion and which continues the recess of the first housing portion;

wherein guide rails for guiding transmission elements are formed in the first and second housing portions;

wherein the transmission elements transmit an actuation of the actuator to a switching element;

wherein the actuator has a geometry formed as a basic body which is adapted to the recess of the holding device and which has guide pockets which guide rams mounted therein; and wherein the rams are U-shaped with two limbs and a transition region; the two limbs of the ram, when actuated, striking against two limbs of the transmission element of the holding device.

22. A holding device for receiving switching elements for a command and alert device, comprising:

a first housing portion in which a recess for receiving an actuator of a command and alert device is arranged; and a second housing portion arranged on the first housing portion and which continues the recess of the first housing portion;

wherein guide rails for guiding transmission elements are formed in the first and second housing portions;

wherein the transmission elements transmit an actuation of the actuator to a switching element; and wherein the rams are U-shaped with two limbs and a transition region, the two limbs of the ram, when actuated, striking against two limbs of the transmission element of the holding device.

* * * * *